US005676079A

United States Patent [19]

Depke

[11] Patent Number: 5,676,079

[45] Date of Patent: Oct. 14, 1997

[54] REDUCED DRAG RUDDER FOR TILLER STEERED SAILBOATS

[76] Inventor: Robert J. Depke, 6863 N. Wildwood, Chicago, Ill. 60646

[21] Appl. No.: 594,105

[22] Filed: Jan. 30, 1996

Related U.S. Application Data

[63] Continuation of Ser. No. 426,816, Apr. 21, 1995, abandoned.

[51] Int. Cl.[6] ..... B63H 25/38

[52] U.S. Cl. ..... 114/162; 114/165

[58] Field of Search ..... 114/39.1, 162, 114/163, 165, 167, 172, 144 C

[56] References Cited

U.S. PATENT DOCUMENTS

| | | | |
|---|---|---|---|
| 2,653,563 | 9/1953 | Long | 114/165 |
| 4,016,824 | 4/1977 | Thyvold | 114/165 |

FOREIGN PATENT DOCUMENTS

| | | | |
|---|---|---|---|
| 1414411 | 12/1965 | France | 114/165 |
| 4317520 | 11/1993 | Germany | 114/162 |
| 0066096 | 4/1982 | Japan | 114/162 |
| 16322 | of 1891 | United Kingdom | 114/172 |
| 2086822 | 5/1982 | United Kingdom | 114/162 |
| 2209724 | 5/1989 | United Kingdom | 114/165 |

*Primary Examiner*—Edwin L. Swinehart
*Attorney, Agent, or Firm*—Hill, Steadman & Simpson

[57] ABSTRACT

An improved rudder for tiller steered sailboats is disclosed wherein a rudder support member is rotatably mounted on an axial support located substantially at the waterline in the aft central portion of a boat. A rudder support guide or track is preferably mounted at a radius defined by the rudder support from the axial support and both supports and locks the rudder support at a desired angle so that the rudder may be maintained at a desired angle with respect to the surface of the water. A spring loaded locking pin preferably locks the rudder support at a desired angle and is attached via a cable to a remote hand release located at the distal end of the tiller for remote operation. A rudder level detection device is also disclosed for use with the present invention which determines the optimum angle of the rudder support of the present invention.

22 Claims, 3 Drawing Sheets

REDUCED DRAG RUDDER FOR TILLER STEERED SAILBOATS

This is a continuation of application Ser. No. 08/426,816 filed Apr. 21, 1995 now abandoned.

BACKGROUND OF THE INVENTION

1. Field of the Invention

The present invention relates generally to the field of sailboat steering devices and, more particularly, the present invention relates to an improved rudder for tiller steered sailboats which decreases unnecessary drag forces for improved performance and increased speed.

2. Description of the Related Art

Conventional sailing rudders have been known for centuries. These devices typically include an elongated tiller member attached to a rudder which is supported by hinges that are fixed to the transom of the boat. The tiller is used to rotate the rudder on its single hinged axis to adjust the angle at which the rudder deflects water. Steering of the boat is thus accomplished by simply rotating the rudder on this single axis. The rudder is mounted on the transom so that when the boat is at rest it will be substantially perpendicular to the surface of the water. These known rudders have been used on sailboats and power craft for many years. While such steering devices typically provide satisfactory control over sailing craft it has been recognized that there are several drawbacks to the use of these conventional devices.

One significant drawback to these devices is that when used on a sailing vessel, they often become inefficient because sailboats often tilt or heel due to the force of the wind on the sails. When the sailboat tilts or heels the rudder also tilts at an angle with respect to the surface of the water and is thus no longer substantially perpendicular to the surface of the water. When the rudder is no longer perpendicular to the surface of the water, it generates an undesired vertical force component in addition to the desired horizontal component of force which is used in steering the boat. The vertical component is undesirable because it only creates an undesired increase of the drag on the boat. The horizontal component is necessary to steer the boat and counteract the forces generated by the wind on the sails which have a natural tendency to push the boat into the wind. When a sailboat is under way, the rudder is always turned in a direction which pushes the boat away from the direction of the wind so that the boat may maintain its current heading. Without the force generated by the rudder, the boat would simply turn into the wind and soon come to a stop. The force generated by the rudder is often substantial, especially for vessels with a large sail area or when a boat is in a strong wind. The problem arises as a result of the tilt or heel of the boat in a strong wind. In strong winds, when a sailboat is heading at an angle upwind, the boat will heel or tilt, as noted, moving the rudder so that it is no longer substantially perpendicular to the plane of the water. Angles of heel are typically in the range of from 10° to 15° but can increase 30° or more to the point on smaller boats when the boat will actually tip over. The magnitude of the unwanted vertical component of force is dependent on the angle of heel or tilt as well as the force generated by the sails. This undesired force can be substantial.

Thus it is recognized that the ability to maintain the rudder of a sailing vessel in a substantially vertical relationship with respect to the surface of the water is desirable. One proposed solution to this problem is disclosed in U.S. Pat. No. 4,867,092 to Halls. The Halls patent discloses a sailing rudder which is comprised of two rudder vanes that are at angles to each other. Neither of the two vanes is directly perpendicular to the surface of the water when the boat is at rest. As the boat heels over with the force of the wind, one of the rudders becomes more perpendicular to the surface of the water than the other rudder, thus becoming more efficient. While this device proposes a solution to the problem there are numerous disadvantages of this device. First of all this design requires two rudder vanes which add to the weight and complexity of the device. Furthermore, with two rudder surfaces in the water there is also increased drag on the back of the boat. Thus, there remains the need in the art for an improved rudder for sailing vessels which is able to maintain the vertical relationship between the rudder and the surface of the water.

It is a first object of the present invention to provide a tiller steered sailing rudder with which a user is able to substantially maintain the vertical relationship between the rudder and the surface of the water.

It is a further object of the present invention to provide a rudder steering device with a further axis of rotation which can readily be locked into various fixed positions along a second axis of rotation to allow the rudder to maintain a substantially vertical relationship with respect to the surface of the water.

It is yet another object of the present invention to provide a tiller steered rudder having a further axis of rotation wherein a user can readily adjust the relationship of the rudder with respect to the surface of the water without moving to the back of the boat.

It is another object of the present invention to provide a mechanism for locating the most efficient rudder position on a sailboat.

Other objects and advantages of the present invention will become apparent from the following summary, detailed description of the invention and the drawings.

SUMMARY OF THE INVENTION

The present invention improves upon the prior art sailboat rudder devices and increases rudder efficiency by providing a rudder for a tiller-steered sailboat wherein the person steering is able to substantially maintain the vertical relationship of the rudder with respect to the surface of the water at all times. The improved sailing rudder of the present invention has two axes of rotation. A first axis of rotation is located substantially at the water line of the sailing vessel and is generally horizontal with respect to the water and extending perpendicular to the boat's transom. This axis is also desirably located in the central portion of the boat's transom. An axial support such as a metal rod, pin or pipe protrudes from the central portion of the transom at a location which is substantially at the water line of the boat. A rotating rudder support member is mounted on this axial support. The rudder for the boat is mounted on hinges which are fixed to the rotatable rudder support rather than the transom as in conventional rudders. An arcuate upper rudder support guide member is located at a radius defined at a fixed distance from the axial support member and provides a guiding track for adjusting the relationship of the rotating rudder support with respect to the surface of the water. The rotating rudder support member is mounted on the axial support and engages the rudder support guide. When the rotatable rudder support is mounted on the axial support and is secured in the upper support or guide track, the rotating rudder support rotates on a first axis of rotation defined by the axial support. The rotatable rudder support member has a slidable car that moves along the guide or track member in an arc and in a selectively lockable manner so that a person steering the boat can adjust the relationship of the rotatable support rudder with respect to the surface of the water as the boat heels thus ensuring that the rudder maintains a substantially perpendicular relationship with respect to the surface of the water at all times. The rudder thus is able to operate at its optimum efficiency and the design eliminates unwanted drag on the boat.

The sliding car member is preferably located at the end of the rotating rudder support and slides along the upper support guide or track. The car or distal end of the rotating rudder support and has a spring loaded locking pin located therein. This spring loaded locking pin is similar to the spring loaded locking pins used in exercise equipment and the like wherein an internal spring pushes the pin into mating holes located in the upper rudder support. The support guide or track has a number of holes located therein for receiving the locking pin at predetermined spaced distances along its arc. The holes receive the locking pin to temporarily secure the sliding car and rotating rudder support at various fixed positions. A person using this device is thus able to ensure that the rudder has a substantially vertical relationship with the surface of the water regardless of the boat's angle of heel. A person is able to adjust the relationship of the rudder with respect to the surface of the water by simply pulling the spring loaded pin and sliding the car member along the upper support guide or track until the locking pin enters the desired hole. In a refined embodiment of the present invention, a remote release cable is attached to the locking pin and extends out to the end of the tiller or tiller extension. In this refined embodiment, it is unnecessary that an individual be located at the back of the boat in order to adjust the angle of the rudder support with respect to the surface of the water. A simple handle release similar to a handlebar brake on a bicycle is capable of releasing the locking pin from the distal end of the tiller. When steering the boat, the person who is controlling the rudder simply releases the locking pin by squeezing the rudder handle release which disengages the locking pin thereby allowing the car member to slide along the upper support guide or track. The person steering the boat is thus able to adjust the vertical relationship of the rudder at a remote location without having to return to the back of the boat. Adjustment of the angle of the rudder is accomplished by grabbing the tiller at two locations along its length and sliding the car member along the track so that the rudder support rotates around the first axis defined by the axial support.

DETAILED DESCRIPTION OF THE PRESENTLY PREFERRED EMBODIMENTS

Figure 1:
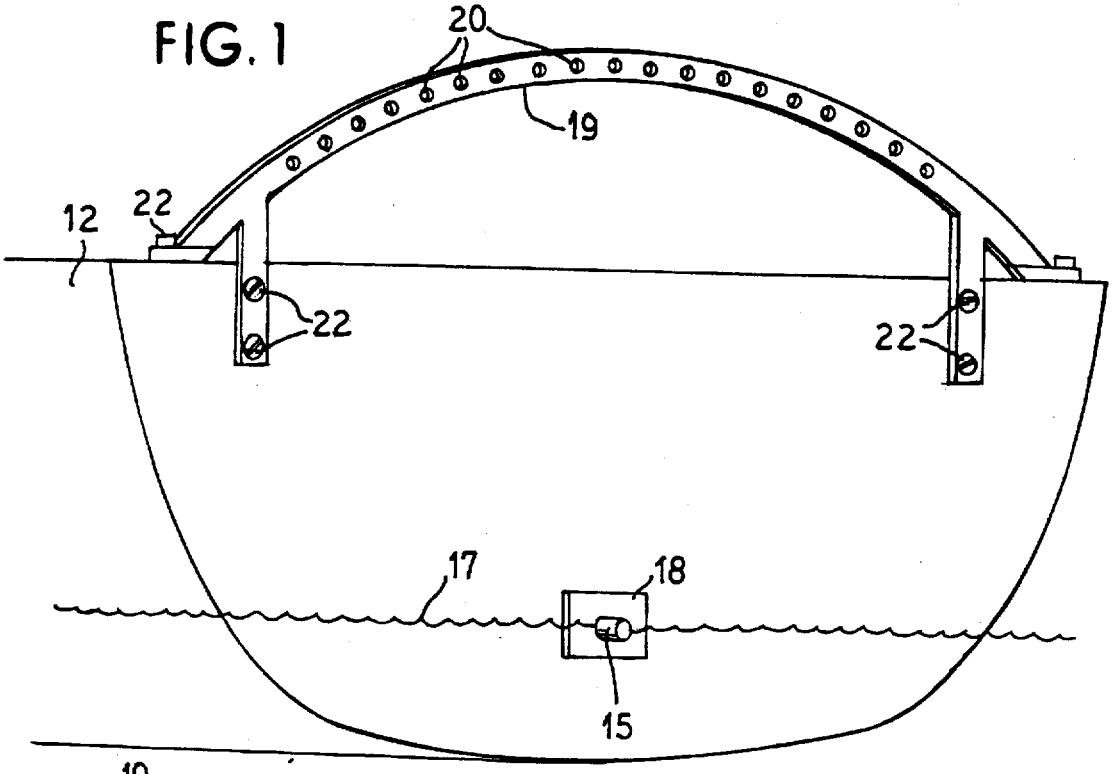
FIG. 1 illustrates an aft view of a boat which incorporates the present invention wherein the arcuate upper support guide or track and primary axial support member are shown without the rudder and rotating rudder support mounted thereon.

FIG. 1 illustrates an aft view of a sailboat which incorporates the present invention. For convenience this illustration does not show the rudder and rotating rudder support attached to the boat. The boat 12 has a protruding axial support member 15 which provides primary support for the rotating rudder support of the present invention. The axial rudder support 15 is located substantially at the water line 17 of the boat 12 and is preferably located in the center the boats transom. The axial support 15 defines a first axis of rotation which is substantially horizontal with respect to the boat and is substantially perpendicular to the transom. It is preferred that this axial support 15 be manufactured of a sturdy metal such as stainless steel. It may be embodied as a rod pin or pipe and preferably extends through the fiber glass boat hull and is secured with structural support members such as the wooden block 18. The block 18 forms a sandwich of the fiberglass with another block inside the boat which is not shown. The axial support may be welded to a metal plate which is secured to the wooden blocks. The axial support is designed to support the rotating rudder support and allow it to rotate on an axis defined by the axial support. An upper rudder support guide or track member 19 is mounted to the back of the sailboat and is also preferably made of stainless steel or aluminum. The illustrated embodiment of the upper rudder support guide or track 19 has a plurality of holes 20 located therein which will be described in greater detail below. Bolts 22 secure the support guide or track to the aft portion of the boat. The guide or track member 19 provides additional support for the rotating rudder support of the present invention which is not shown in this Figure.

Figure 2:
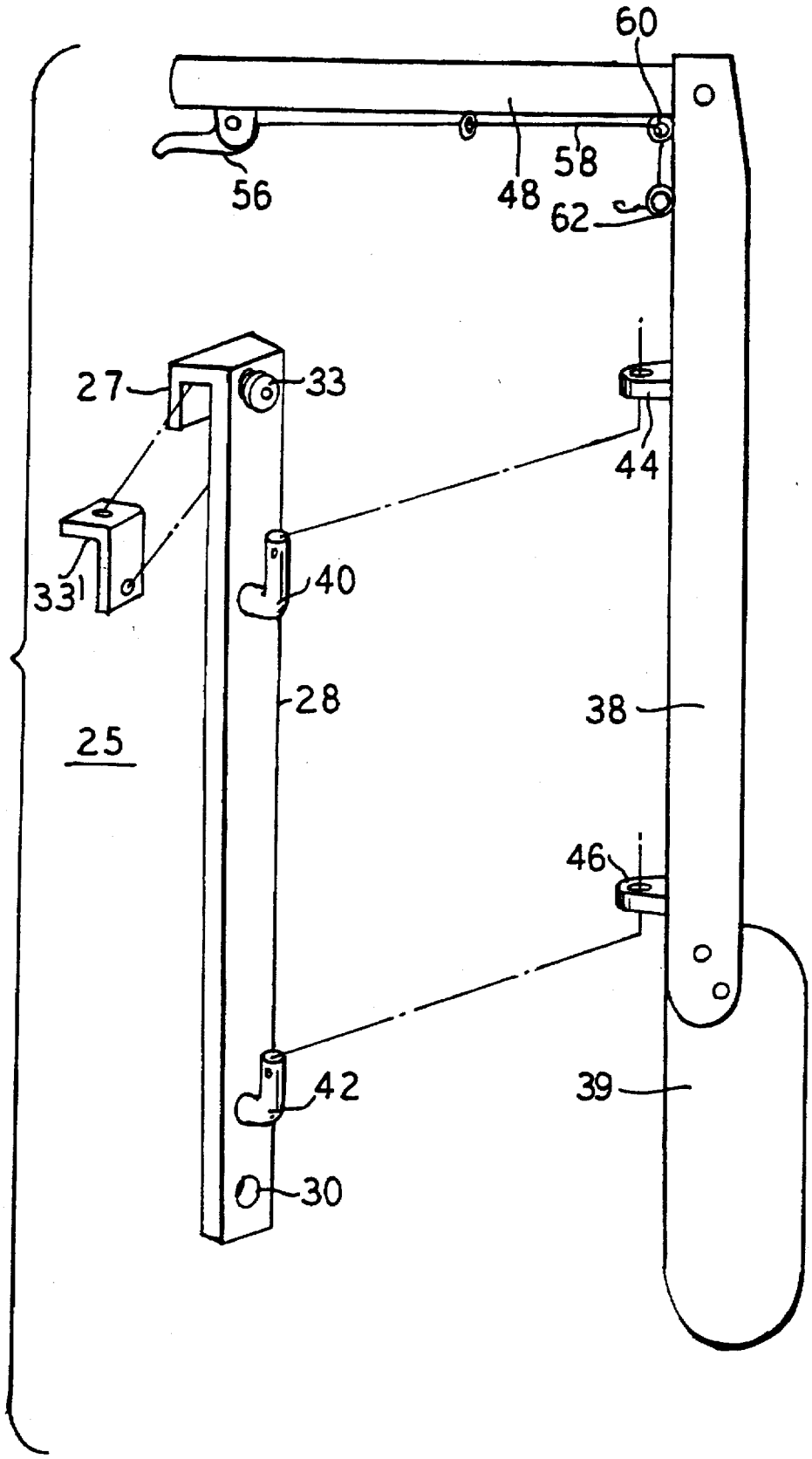
FIG. 2 illustrates a side view of the improved rudder of the present invention prior to attachment of the rotating rudder support to the axial support and arcuate support guide or track.

FIG. 2 illustrates the preferred embodiment of the rotating rudder support of the present invention generally at 25. A rudder support guide car 27 is preferably formed in or located on the distal end of the elongated rotating rudder support member 28 and is designed to engage the upper rudder support guide or track 19 as the rotating rudder support 28 rotates about a first axis of rotation defined by the axial support 15. Installation of the rotating rudder support 28 is accomplished by inserting the axial support 15 into the axial support hole 30 on the rotating rudder support member 28. This is done with the rotating rudder support 28 at a substantially horizontal angle such that the support guide car 27 at the distal end of the rotating rudder support 28 is not in contact with the upper rudder support guide or track 19. A locking pin is inserted into a hole in the distal end of the axial rudder support 15 to lock the elongated rotating rudder support into place while allowing the rotating rudder support 28 to rotate freely on the axis defined by the axial support 15. This should be a cotter pin or similar device. The cotter pin which is inserted into the end of the axial support is not shown for the sake of convenience. It is recognized that other alternate means for rotatably securing the rotating rudder support to the axial support may be used as well.

The elongated rotating rudder support 28 is then rotated on the axial support member 15 so that the support guide car 27 at the distal end of the rotating support member 28 engages the upper arcuate support guide or track 19. A spring loaded locking pin 33 mounted through the rotating rudder support 28 must be pulled back in order to allow the rotating rudder support 28 to freely rotate along the arc defined by the upper arcuate support 19 around the first axis of rotation defined by the axial support 15. During initial installation of the rudder of the present invention, it is preferred that the rotating rudder support member 28 be secured in a substantially vertical relationship such that when the boat is at rest in calm water the rudder would be positioned vertically on the boat. This is accomplished simply by releasing the spring loaded locking pin 33 when the car 27 is positioned over one of the holes 20 in the upper arcuate support 19 which is directly above the axial support 15. The spring mechanism within the rotating rudder support 28 then forces the locking pin 33 into the hole 20. A guide car locking member 33 secures the rotating rudder support to the upper support 19. This may be accomplished with bolts that secure the locking member 33 to different portions of the car 27 and/or the rotating rudder support 28 to surround the upper support 19. The guide car locking member 33 thus secures the rotating rudder support 28 to the upper arcuate support 19 to prevent the rudder support from rotating off of the upper arcuate support 19. In the preferred embodiment of the present invention, the guide car 27 is illustrated as a substantially U-shaped piece of metal which is molded or formed into the distal end of the rotating rudder support member 28, however, it is recognized that other designs are equally suitable. In the illustrated preferred embodiment, the rotating support is supported by the upper support 19 via the car 27. The car slides along the upper support to provide support. In an alternate embodiment, for example, it may be desirable to add rubber rollers mounted on axles located within the guide car to allow for easier rotational movement of the guide car and elongated support member. However, because of the added expense of these items and due to the fact that metal car should provide satisfactory results, these rubber rollers are not part of the presently preferred embodiment. Additionally, the arcuate support guide could be located within the transom of the boat and rather than have the guide car 27 add support to the rudder and also provide the mechanism for locking the rudder into various angles, it may simply be the mechanism for locking the rudder into various fixed positions without providing additional support for the rudder. It should also be noted that alternate devices may also be selected for securing the rudder into various fixed positions other than the locking pin of the present invention. For example, a spring loaded mechanism with teeth or gears on the elongated rudder support could be used to engage a fixed member with teeth or gears which are fixed to the transom of the boat. Other less desirable locking mechanisms include sliding car members having adjustable clamps or screws for securing the rudder into various fixed positions.

Figure 3:
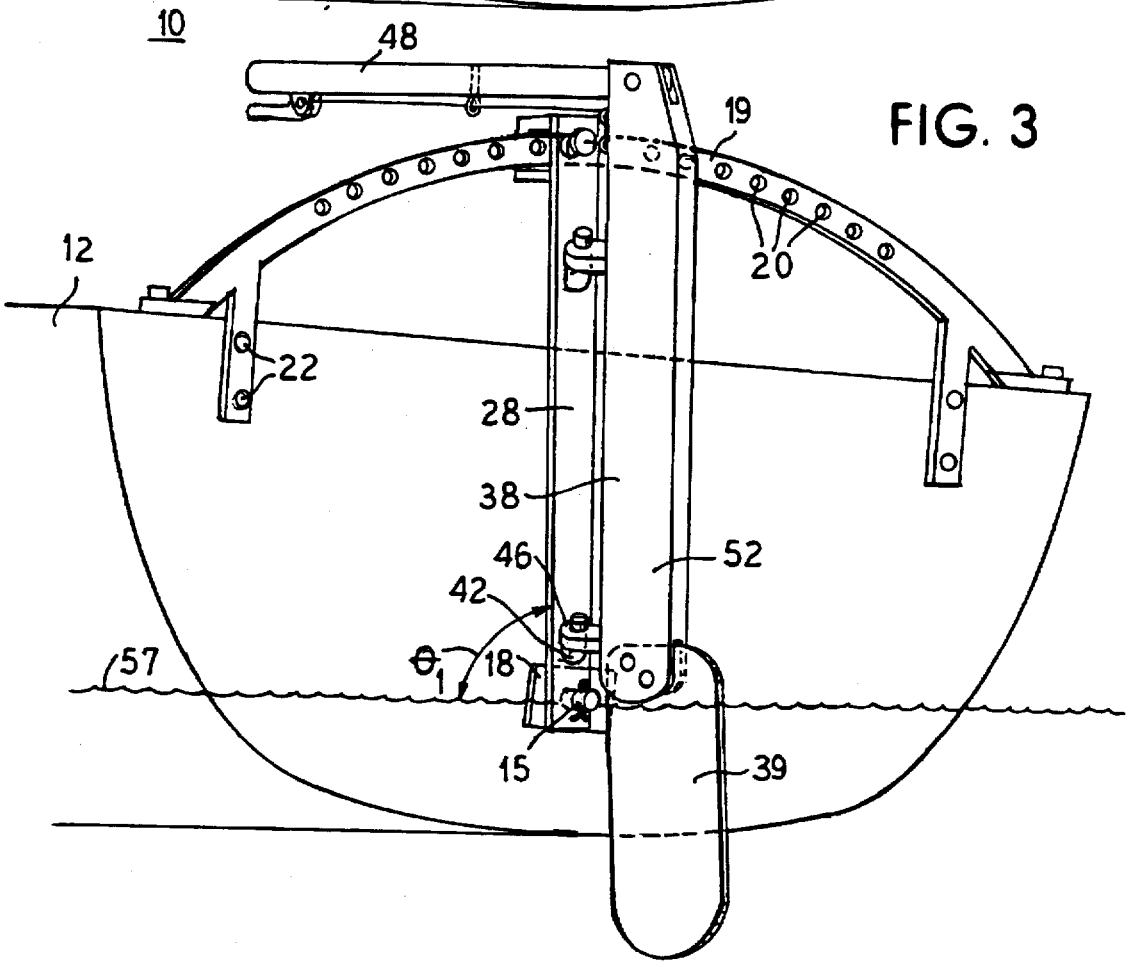
FIG. 3 illustrates a perspective view of the improved rudder device of the present invention attached to the back of a boat wherein the rudder is maintained substantially perpendicular to the surface of the water while the boat is tilted at an angle with respect to the surface of the water.
Figure 5:
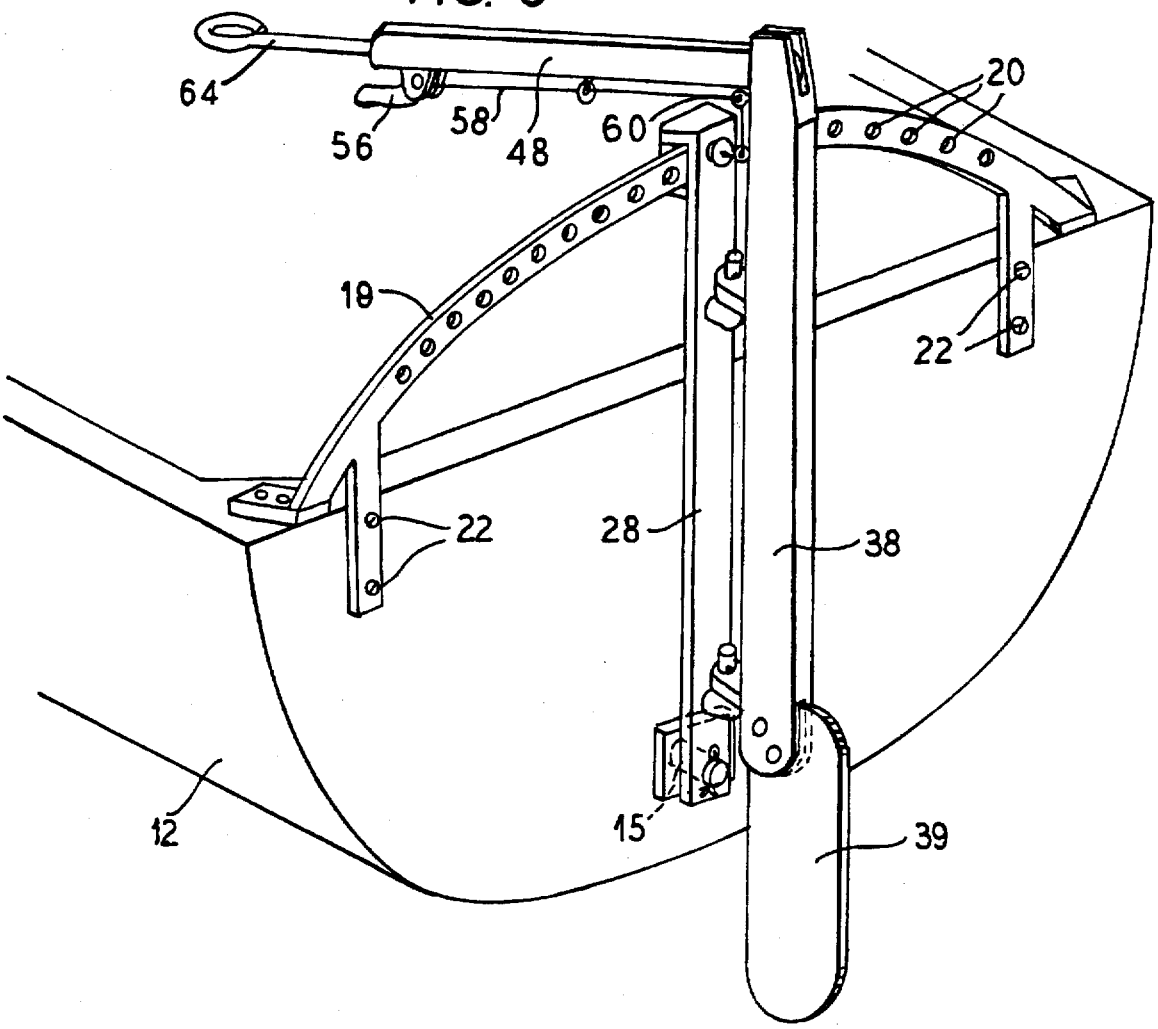
FIG. 5 illustrates an alternate embodiment of the present invention for use on smaller boats.

In the preferred embodiment shown in FIGS. 2, 3 and 5, a rudder which is comprised of a rudder upper bracket 38 and rudder vane 39 is mounted on hinge pins 40 and 42 which are fixed to the rotating rudder support 28. Hinges 44 and 46 which are fixed to the rudder upper bracket 38 engage the hinge pins 40 and 42. The attachment of the rudder upper bracket 38 to the rotating rudder support 28 is thus much the same as the attachment of a conventional rudder to the transom of a boat. The hinges define a second axis of rotation which is similar to that of conventional tiller steered devices. The primary difference being that the rotating rudder support 28 of the present invention to which the hinge pins are attached provides an easy mechanism for rotation of the rudder so that the rudder may be temporarily fixed to the angle at which the rudder is most efficient.

A tiller 48 is secured to the rudder upper bracket 38 for steering of the boat as in conventional rudders. Steering of the boat is thus accomplished by rotating the rudder on the second axis of rotation defined by the hinges 44 and 46 with the tiller 48. The rudder vane 39 is the portion of the rudder which actually deflects the water for steering the boat. In the preferred embodiment of the present invention, the improved rudder has a remote release for the locking pin 33. The remote release is comprised of a hand release 56 which is very similar to the handlebar brakes on a bicycle. The hand release 56 is attached to a remote release cable 58 which passes through a eyelets 60 and 62 that are fixed to the rudder upper bracket 38. These eyelets allow the cable to feed down and loop back to the locking pin 33. By simply squeezing on the hand release 56, a person using the improved rudder of the present invention is thus able to remotely release the locking pin and thereby adjust the angle of the rudder without necessarily being at the back of the boat. This is especially advantages for small boat racers who need increased speed but do not want to be unnecessarily inconvenienced by being required to move to the back of the boat each time it is necessary to adjust the angle of the rudder. In a boat having this remote release capability, adjustment of the rudder is accomplished by squeezing the remote release handle 56 and grabbing the tiller 48 at two places along its length. With the locking pin 33 disengaged, the rudder support freely rotates around the first axis of rotation defined by the axial support 15 to the next desired angle. The remote hand release 56 is then released and the spring loaded locking pin then inserts itself into the closest hole 20 in the upper arcuate support 19. It is recognized that in order to insert the pin it may be necessary to slide the guide car back and forth slightly to find the next hole, however, it is believed that such adjustment can be readily accomplished. The spring-loaded locking pin 33 is similar to that used in exercise equipment. It has a spring which is internal to the rotating rudder support 28 (not shown). It has a normally extended condition for engaging holes 20 in upper support 19.

FIG. 3 illustrates the improved rudder of the present invention as it is attached to the back of a boat during operation. It can easily be recognized that the boat 12 is slightly tilted with respect to the surface of the water 57 which is typical as previously noted. Although the boat is tilted with respect to the surface of the water, the improved rudder is actually substantially perpendicular to the water and is thus operating at its optimum efficiency as seen by the angle e which is approximately 90°. If the angle of heel changes, the angle of the rudder may also be easily adjusted to compensate for this change and thus maintain the rudder in a substantially vertical relationship with respect to the surface of the water.

In the preferred embodiment of the present invention, the upper support guide or track 19 is embodied as an arcuate member which extends up above the surface of the boat. While this is preferred as it provides numerous advantages, it is recognized that alternate designs may be satisfactorily used as well. In the preferred embodiment the upper arcuate support member 19 may provide additional support for people on the boat and in larger vessels it may be incorporated into the lifelines on the boat to prevent people from falling over. In smaller vessels, it may be desirable to be much lowest so that it does not compete for surface area on the boat. In one alternate embodiment, two sliding cars may be used. in such a design, one would travel along the rotating rudder support and the other would travel along a fixed horizontal member as the rotating support is turned.

Figure 4:
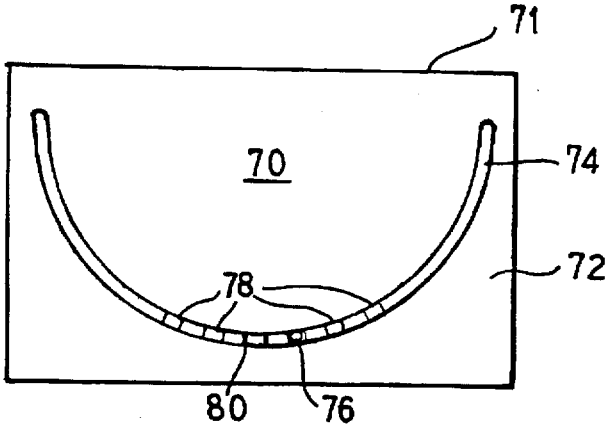
FIG. 4 is a plan view of a rudder level detection device for use with the present invention.

FIG. 4 illustrates a rudder level detector 70 for use with the present invention. The rudder level detector 70 is a simple mechanism for determining the most efficient angle for the rudder of the present invention. The rudder level detector 70 is preferably secured to the elongated rudder support member 28 slightly below the guide car 27 facing toward the bow of the boat so that it is readily visible to a person sailing the boat. It is fixed so that its top 71 is perpendicular to each of the sides of the rotating rudder support member 28. The rudder level detector 70 is essentially a modified clinometer. A clinometer is a device that is used to measure the angle of heel of a boat. The rudder level detector of the present invention is comprised of a plastic mounting support 72 a clear plastic arcuate hollow tube 74 which is filled with a fluid and a single stainless steel ball 76. In an alternate embodiment, the rudder level detector is embodied as having an arc opposite to that shown in FIG. 4 and which used an air bubble to define the optimum angle. The fluid dampens the motion of the ball 76 in the tube 74. In order to verify that the rudder is at its optimum angle of efficiency, it is desirable to maintain the rudder in a substantially vertical relationship with respect to the surface of the water. In order to determine the actual angle of the rudder, the arcuate tube 74 is marked with gradations 78 and primary central gradation 80. In order to have the rudder at its angle of optimum efficiency, the steel ball 76 should be always located in the bottom within the primary central gradation 80. When the ball is in this location it indicates that the rudder is thus substantially perpendicular to the surface of the water. The remaining gradations are calibrated to indicate when the rudder is one or more locking pin holes away from optimum efficiency. Calibration is done when the boat is in dry dock on a level surface. On a level surface, when the rudder is secured in the center of the arcuate support 19, the steel ball should be located in the primary central gradation 80. The rudder support is then shifted over to each of the subsequent positions along the arcuate support member 19. When the rudder support is fixed so that the locking pin 33 is secured into one of the holes adjacent to the hole in the center of the arcuate support member 19, the steel ball will then come to rest at a new position within the hollow arcuate member 74. This position is then marked and the procedure is repeated for each of the subsequent holes on each side of center from the top center hole in the arcuate upper support member 19. Thus there is a one-to-one correspondence between the holes in the arcuate upper support and the gradations 78 on the rudder level detector.

Use of this device will now be described wherein it is assumed that a person using the improved rudder of the present invention begins sailing with the locking pin initially secured in the hole located in the middle of the upper arcuate support 19. When the boat is under way and it begins to heel or tilt, the steel ball will move in the hollow tube 74. This is due to the fact that gravity will maintain the ball in the lowest position on the arc. When the ball reaches the first gradation on either side of the primary central gradation 80, it is recognized that operation of the rudder will be more efficient if the rudder support is rotated on its axis. The desired direction of rotation is determined by the current position of the steel ball. Rotation always should be done in the direction away from the side of the rudder level detector at which the steel ball is currently located. The rudder level detector also indicates the number of holes which the rudder support should be moved from its current location. For example, if the steel ball is a single gradation over to the side, the rudder support locking pin only need be moved a single hole over in the upper arcuate support guide or track 19. If the steel ball is two gradations over, the rudder support locking pin is moved over two holes, etc. It is also recognized that one should use the general position of the ball 76 over a brief period of time as an indication of when to adjust the rudder. This is due to the fact that the motion of the boat may temporarily cause the ball 76 to inadvertently move to another gradation.

FIG. 5 illustrates a further embodiment of the present invention for use on smaller racing type boats. In this embodiment, numbers corresponding to like elements previously described are also employed in this figure. One difference this embodiment is that the upper support 17 is dimensioned and proportioned such that a tangent to its arc substantially does not intersect the sides of the boat 12. This allows the tiller 48 which is located above the support 19 to rotate freely about the second axis defined by the hinges without hitting the sides of the boat 12. This would occur with the rotating support 28 rotated substantially from the central hole in the upper support 19. For example, this would occur if the support were located at the leftmost or rightmost holes in the upper support 19 and the tiller moved toward the nearest boat side. In larger boats this would probably not be a concern. FIG. 5 also illustrates a conventional tiller extension which may be attached to the tiller 48. This is attached to the tiller 48 conventionally, such as with a ball joint or the like.

The present invention is subject to many variations modifications and changes in detail. For example, the car can be engaged to the arcuate member with gear teeth or the like to secure the rudder in a particular position. It is intended that all matter described throughout the specification and shown in the accompanying drawings be considered illustrative only. Accordingly, it is intended that the invention be limited only by the spirit and scope of the appended claims.

I claim as my invention:

1. A steering mechanism for a sailboat comprising:

an axial support fixed to a transom of the sailboat;

a rotating rudder support attached to the axial support;

a rudder support guide fixed to the sailboat above the axial support, a car member fixed to the rotating rudder support in sliding engagement with the rudder support guide;

at least one rudder hinge located on the rotating rudder support;

a rudder rotatably mounted on the at least one rudder hinge; and a tiller fixed to the rudder.

2. The steering mechanism for a boat of claim 1, further comprising a spring loaded locking pin attached to the rotating rudder support extending into a hole located in the rudder support guide.

3. The steering mechanism for a boat of claim 2, further comprising a first end of a remote release cable attached to the locking pin.

4. The steering mechanism for a boat of claim 3, further comprising a remote handle release connected to a second end of the remote release cable.

5. The steering mechanism for a boat of claim 4, wherein the handle release is attached to the tiller.

6. The steering mechanism for a boat of claim 1, further comprising a rudder level detector attached to the rotating rudder support.

7. A method for steering a sailboat, the sailboat comprising:

an axial support pin fixed to a transom of the sailboat;

a rotating rudder support attached to the axial support;

a rudder support guide fixed to the sailboat above the axial support;

a car member fixed to the rotating rudder support in sliding engagement with the rudder support guide;

at least one rudder hinge located on the rotating rudder support;

a rudder rotatably mounted on the at least one rudder hinge; and a tiller fixed to the rudder; said method comprising the steps of:

fixing the rotating rudder support in a first location along the rudder support guide;

rotating the rudder on the at least one rudder hinge with the tiller;

rotating the rotating rudder support around an axis defined by the axial support pin; and fixing the rotating rudder support in a second location along the rudder support guide.

8. The method of steering a sailboat of claim 7, wherein the step fixing the rotating rudder support in a first location comprises the additional step of inserting a spring loaded locking pin into a first hole located in the rudder support guide.

9. The method of steering a sailboat of claim 8, wherein the step fixing the rotating rudder support in a second location comprises the additional step of inserting the spring loaded locking pin into a second boise located in the rudder support guide.

10. The method of steering a sailboat of claim 9 comprising the additional step of examining a rudder level detector attached to the rotating rudder support prior to inserting the locking pin into the second hole.

11. The method of steering a sailboat of claim 7, wherein the step fixing the rotating rudder support in a first location comprises the additional step of inserting a spring loaded locking pin into a first hole located in the rudder support guide and support.

12. The method of steering a sailboat of claim 8, wherein the step fixing the rotating rudder support in a second location comprises the additional step of inserting the spring loaded locking pin into a second hole located in the rudder support guide and support.

13. The method of steering a sailboat of claim 9 comprising the additional step of examining a rudder level detector attached to the rotating rudder support prior to inserting the locking pin into the second hole.

14. A steering mechanism for a sailboat comprising:

an axial support fixed to a transom of the sailboat;

a rotating rudder support attached to the axial support;

a rudder support guide and support fixed to the sailboat above the axial support, a car member fixed to the rotating rudder support in sliding engagement with the rudder support guide and support;

at least one rudder hinge located on the rotating rudder support;

a rudder rotatably mounted on the at least one rudder hinge; and a tiller fixed to the rudder.

15. The steering mechanism for a boat of claim 14, further comprising a spring loaded locking pin attached to the rotating rudder support extending into a hole located in the rudder support guide and support.

16. The steering mechanism for a boat of claim 15, further comprising a first end of a remote release cable attached to the locking pin.

17. The steering mechanism for a boat of claim 16, further comprising a remote handle release connected to a second end of the remote release cable.

18. The steering mechanism for a boat of claim 17, wherein the handle release is attached to the tiller.

19. The steering mechanism for a boat of claim 14, further comprising a rudder level detector attached to the rotating rudder support.

20. A method for steering a sailboat, the sailboat comprising:

an axial support pin fixed to a transom of the sailboat;

a rotating rudder support attached to the axial support;

a rudder support guide and support fixed to the sailboat above the axial support; a car member fixed to the rotating rudder support in sliding engagement with the rudder support guide;

at least one rudder hinge located on the rotating rudder support;

a rudder rotatably mounted on the at least one rudder hinge; and a tiller fixed to the rudder; said method comprising the steps of:

fixing the rotating rudder support in a first location along the rudder support guide and support;

rotating the rudder on the at least one rudder hinge with the tiller;

rotating the rotating rudder support around an axis defined by the axial support pin; and fixing the rotating rudder support in a second location along the rudder support guide and support.

21. A steering mechanism for a sailboat comprising:

a rudder;

a means for locking and unlocking the rudder in a plurality of positions which alter an angle of the rudder generally around an axis parallel to a bow to stern line; and a remote actuation means operable to actuate the means for locking and unlocking at a distance away from the means for locking and unlocking; and wherein the remote actuation means comprises a cable attached to a spring-loaded pin, said cable extending to a release mechanism.

22. The steering mechanism of claim 21, wherein said cable extends to a distal end of the tiller where the cable is secured to the release mechanism.

* * * * *